US009789728B2

(12) United States Patent
Glade et al.

(10) Patent No.: US 9,789,728 B2
(45) Date of Patent: Oct. 17, 2017

(54) METHOD FOR SUPPLYING DOCUMENT SETS AND INSERTING DOCUMENT SETS INTO ASSOCIATED ENVELOPES AND ENVELOPING SYSTEM

(71) Applicant: Winkler + Dünnebier GmbH, Neuwied (DE)

(72) Inventors: Reinhard Glade, Königstein (DE); Gerd Mattern, Butzbach (DE); Andreas Völz, Friedberg (DE)

(73) Assignee: Winkler + Dünnebier GmbH, Neuwied (DE)

( * ) Notice: Subject to any disclaimer, the term of this patent is extended or adjusted under 35 U.S.C. 154(b) by 0 days.

(21) Appl. No.: 14/916,317

(22) PCT Filed: Aug. 27, 2014

(86) PCT No.: PCT/EP2014/002332

§ 371 (c)(1),
(2) Date: Mar. 3, 2016

(87) PCT Pub. No.: WO2015/032475

PCT Pub. Date: Mar. 12, 2015

(65) Prior Publication Data

US 2016/0200135 A1 Jul. 14, 2016

(30) Foreign Application Priority Data

Sep. 6, 2013 (DE) ..... 10 2013 217 900

(51) Int. Cl.
*B43M 3/04* (2006.01)
*B65H 39/06* (2006.01)
*B65H 43/08* (2006.01)

(52) U.S. Cl.
CPC ..... *B43M 3/04* (2013.01); *B65H 39/06* (2013.01); *B65H 43/08* (2013.01)

(58) Field of Classification Search
CPC ..... B43M 3/04; B65H 39/06; B65H 43/08
(Continued)

(56) References Cited

U.S. PATENT DOCUMENTS 4,547,856 A * 10/1985 Piotroski ..... B07C 1/00 270/56
4,733,856 A * 3/1988 Gunther, Jr. ..... B07C 1/00 270/1.02

(Continued)

FOREIGN PATENT DOCUMENTS

DE 690 22 896 T2 6/1996
EP 0406976 A1 1/1991

(Continued)

OTHER PUBLICATIONS

Kelliher, Cormac; International Search Report and Written Opinion; International Application No. PCT/EP2014/002332; Mar. 11, 2014; European Patent Office; Rijswijk, Netherlands.

(Continued)

*Primary Examiner* — Patrick Mackey
(74) *Attorney, Agent, or Firm* — Stevens & Showalter LLP

(57) ABSTRACT

A method for supplying and inserting document sets into associated envelopes, in which the document sets are supplied to an insert station in a document material stream and the envelopes are supplied to the insert station in an envelope material stream, to allow mail pieces to be collated with high reliability. In the insert station, the document set supplied in each case is inserted into the relevant envelope supplied at the same time, wherein for each document set, the position thereof in the document sequence and an associated document identification code are determined, and for each envelope, the position thereof in the envelope sequence and an associated envelope identification code are determined, and a document set and an envelope are sup- (Continued)

plied to the insert station only as a pair when it is confirmed that the envelope pending supply is individually associated with the document set pending supply.

4 Claims, 2 Drawing Sheets

(58) Field of Classification Search
USPC ..... 270/1.02, 1.03, 58.06
See application file for complete search history.

(56) References Cited

U.S. PATENT DOCUMENTS 4,734,865 A 3/1988 Scullion et al.
5,317,654 A * 5/1994 Perry ..... B07C 1/00 209/584
5,510,997 A 4/1996 Hines et al.
5,649,026 A * 7/1997 Heins, III ..... B07C 3/14 235/386
5,730,299 A 3/1998 Helsley
6,249,716 B1 * 6/2001 Edens ..... B07C 1/00 270/52.02
7,097,095 B2 * 8/2006 Conard ..... B07C 3/00 235/375
7,325,375 B2 * 2/2008 Graushar ..... B65H 39/06 270/1.02
7,717,413 B2 * 5/2010 Wiegmann ..... B43M 3/04 270/52.02
8,028,982 B2 * 10/2011 Gorp ..... B43M 3/04 270/58.06
8,406,463 B2 * 3/2013 Quinn ..... B43M 3/04 382/101
9,108,752 B2 * 8/2015 Ponti ..... B43M 3/04
9,469,152 B2 * 10/2016 Hoepner ..... B43M 3/04
2001/0032033 A1 * 10/2001 Krasuski ..... G07B 17/00193 700/220
2006/0284360 A1 * 12/2006 Hume ..... B42C 1/10 270/1.02
2008/0030746 A1 * 2/2008 Matsunaga ..... B07C 5/3412 358/1.1
2010/0145883 A1 * 6/2010 Guyett ..... G07B 17/00467 705/406
2011/0084437 A1 4/2011 Skinger
2012/0076352 A1 3/2012 Quinn et al.

FOREIGN PATENT DOCUMENTS

WO 9318480 A1 9/1993
WO WO 9318480 A1 * 9/1993 ..... B07C 1/00
WO 2015032475 A1 3/2015

OTHER PUBLICATIONS

German Office Action dated Jun. 27, 2014 for application No. 10 2013 217 900.6; German Patent Office.

* cited by examiner

METHOD FOR SUPPLYING DOCUMENT SETS AND INSERTING DOCUMENT SETS INTO ASSOCIATED ENVELOPES AND ENVELOPING SYSTEM

The invention relates to a method for supplying document sets and inserting document sets into associated envelopes, in which the document sets are supplied to an insert station in a document material stream formed by a sequence of document sets and the envelopes are supplied to the insert station in an envelope material stream formed by a sequence of envelopes. It also relates to an enveloping system for carrying out the method.

In modern enveloping systems, mail pieces are conventionally prepared for mailing in large numbers, a mail item, for example one or more documents such as letters or the like, being automatically inserted into an envelope and prepared for subsequent further processing or actual mailing. To this end, the enveloping systems are conventionally provided with insert stations in which the mail items are inserted into the respective envelopes. The components required for the mail pieces, that is to say in particular the envelopes, on the one hand, and the documents or document sets, on the other hand, are supplied to such an insert station as sequential material streams by means of feed devices suitably arranged upstream.

In such systems, individualised or personalised treatment and preparation of the mail pieces are increasingly important. For example, mail that is to be sent out in large numbers is no longer produced in the form of anonymous bulk mailings which are sent in identical form to a large number of addressees, but such mail is instead matched and adapted to the individual recipient or addressee, for example by providing the documents or also the envelopes with data, information, print or the like that is specific to the recipient. Such personalisation or individualisation can thereby be fully matched to the actual recipient by also processing personal data, for example address data or also confidential data, for example financial data, including salary statements or the like. Alternatively or in addition, however, data relating to groups of people, for example data specific to gender, age group, language region or the like, can also be used.

Precisely in the case of the automated production of such personalised or individualised mail pieces, high reliability when merging the individual components is of very considerable importance. For example, when mailing confidential data, for example salary statements or the like, particular attention must be paid to ensuring that, when the document sets are collated from the single documents and combined with the intended envelope, the correct single documents containing the confidential data are also addressed to the intended and correct recipient.

Accordingly, the object of the invention is to provide a method of the above-mentioned type which allows the mail pieces consisting of the document sets and the envelopes to be collated with particularly high reliability and precision in a particularly simple manner. An enveloping system which is particularly suitable for carrying out the method is also to be provided.

With regard to the method, this object is achieved according to the invention in that, in the insert station, the document set supplied thereto is inserted into the relevant envelope supplied at the same time, wherein for each document set guided in the document material stream, the position thereof in the document sequence and a document identification code associated therewith are determined, and for each envelope guided in the envelope material stream, the position thereof in the envelope sequence and an envelope identification code associated therewith are determined, and wherein a document set and an envelope are supplied to the insert station only as a pair and the supply thereof is authorised only when it is confirmed on the basis of the relevant document identification code and the relevant envelope identification code that the envelope pending supply is individually associated with the document set pending supply.

The invention is based on the consideration that mutually associated components of the particular mail item can be collated particularly reliably on the basis of suitably chosen identification codes which are suitably affixed to the respective components, that is to say in particular to the envelopes, on the one hand, and to the document sets and/or the single documents forming the document sets, on the other hand. The identification codes can be barcodes or other suitable identification means, it being possible in particular also to use internally allocated serial numbers in ascending or descending order for the individual components within their particular material stream. These identification codes can be created during production of the component in question, that is to say of the document or of the envelope, and affixed to the particular object so that it is possible to trace and identify the particular component at any time throughout the process. Such individually allocated identifications can also be used in a particularly simple manner for the matching which is now to be carried out, that is to say in order to ensure that an individually produced single document or a document set including such a document is also inserted into the correct, individually associated envelope. To this end, it is provided that the document/document set, on the one hand, and the associated envelope, on the other hand, are supplied to the insert unit as a pair and simultaneously (within the limits of conventional process tolerances). However, in order to ensure high reliability in the production process, this is to occur only if it has previously been possible to verify on the basis of the identification codes the correct association of the envelope and the document set. It is thus ensured that only mail pieces which have been identified as correctly allocated are produced and prepared for further processing. Incorrect or dubious products or product combinations, on the other hand, are reliably avoided.

The identification codes of the envelopes and document sets guided in the material streams are advantageously stored in a control unit of the enveloping system and kept available as the basis for system-related information, for example for the purpose of tracking the processing status of the particular product or mail item. The corresponding detection can advantageously take place at a comparatively early stage when the part in question enters the corresponding material stream, and therefore the corresponding identification information can be used in the production process for a comparatively long period of time. Particularly advantageously—and if the detection point is sufficiently upstream in terms of "process technology" of the feed point into the insert station—the identification information can also be used as a prognosis in order for products that are shortly to be fed in, the corresponding partners are still present in the material stream. Accordingly, in a particularly advantageous embodiment, in the case where the envelope pending supply to the insert station is not individually associated with the document set pending supply to the insert station, it is determined on the basis of the detected identification codes stored in the control system whether a document set or envelope associated with the envelope pending supply or with the document set pending supply is already in the corresponding material stream, that is to say is still expected to arrive at the insert station.

In principle, it is provided only to produce correctly synchronised packaged items in the insert station. Accordingly, only those pairs consisting of an envelope, on the one hand, and of a document set, on the other hand, for which it has been possible to verify correct mutual association are to be conveyed further to the insert station. For the other envelopes and document sets, on the other hand, for which a correct association could be determined, it is provided in an advantageous embodiment that they be discharged from the relevant material stream before supply to the insert station.

With regard to the enveloping system, the stated object is achieved by an insert station, upstream of which, on the material stream side, there are arranged a first feed device for supplying envelopes and a second feed device for supplying document sets, it being possible to drive the feed devices separately and independently of one another. The fact that the feed devices can be driven separately allows positioning and association errors between the material streams to be corrected by, for example, driving only one of the feed devices and temporarily stopping the other so that changes in the alternate associations are possible.

In order to allow the material streams to be systematically detected and monitored and, on the basis thereof, the correct mutual association of the individual components to be detected, the feed devices advantageously each have a detection unit for reading identification codes affixed to the envelopes and/or document sets. The identification codes can be, for example, barcodes or the like, by means of which individualised monitoring of the material streams is possible. In a further advantageous embodiment, the detection units are each connected on the data output side to a central control unit. In an advantageous further development, the detected identification codes, optionally supplemented with further product-specific information or data, are stored in the control unit as a log and kept available for the purposes of further monitoring within the system.

In a particularly advantageous embodiment, the control unit is designed to control the driving of the feed devices depending on the identification codes determined in the detection units. For the correction of association errors in the material streams ("mismatch correction"), it is possible in particular to provide selective control of the feed devices, such that one of the feed devices is temporarily stopped and the corresponding material stream is thus stopped, while the other material stream is conveyed further until matching, mutually associated envelopes, on the one hand, and document sets, on the other hand, are again present in pairs.

An embodiment of the invention will be explained in greater detail by means of a drawing, in which.

Figure 1:
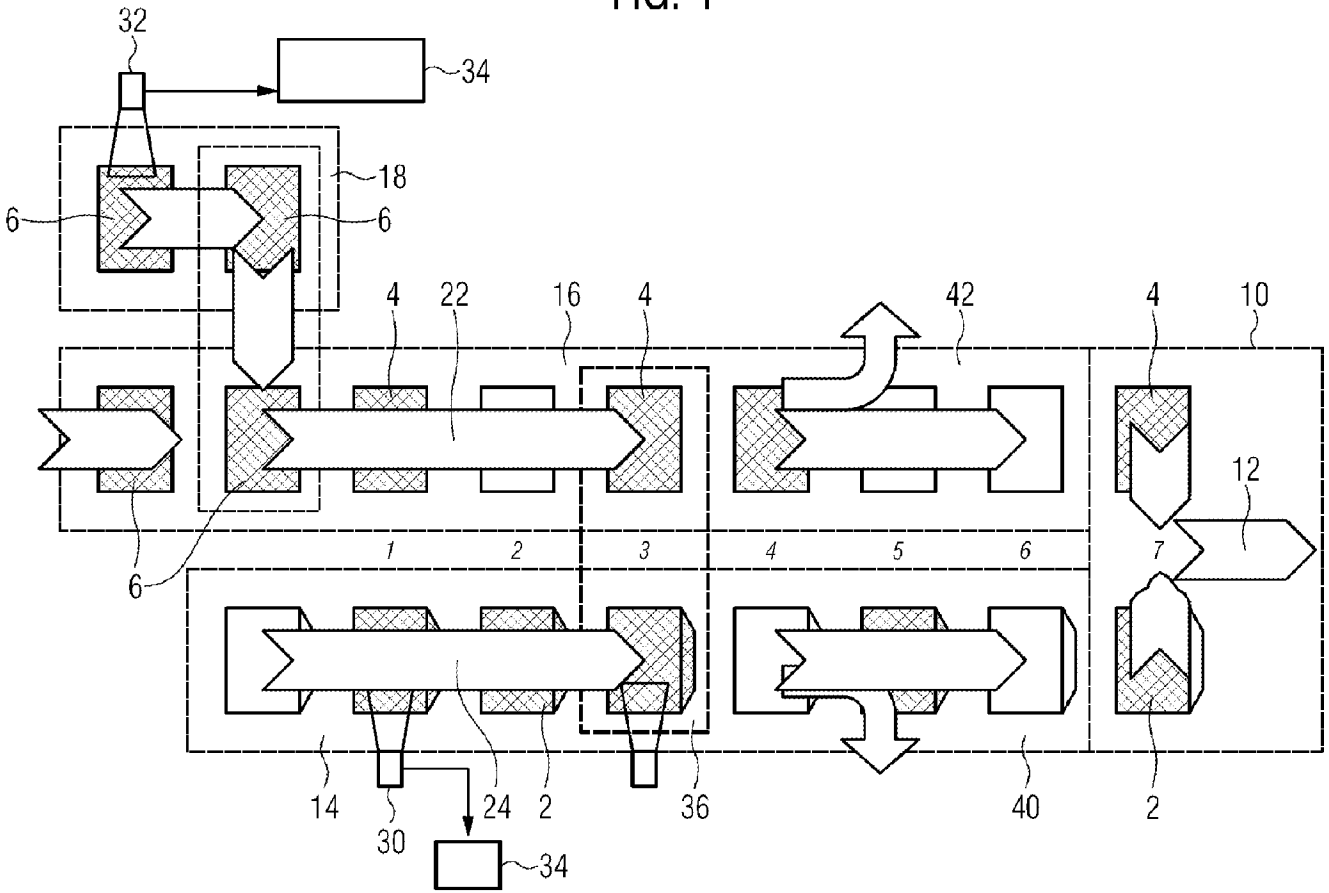
FIG. 1 is a schematic view of an enveloping system.

The enveloping system 1 shown schematically in the figure is designed for preparing personalised enveloped mailings or mail pieces, in particular postal items. In this context, "personalised" is to be understood in particular as meaning that, in the preparation of the mail pieces, personal contents or a personal mail item is purposively combined with an associated envelope 2 that is specific to the same person, and is inserted into that envelope to form the postal item. The personal form of the mail item, on the one hand, and of the envelope 2, on the other hand, can, for example, be such that the mail item has contents that are specifically customised and relate to an individual person or a group of people, and optionally also personal data, for example, address data or the like, the associated envelope 2 having applications, content or the like, for example, printing, relating to the same person or to a group of people to be associated with that person, for example gender, age or the like.

In the embodiment, the personal mail item is in each case formed of a document set 4, which can in turn consist of a number of, that is to say one or more, single documents 6. The single documents 6 can in turn contain individualised and personal information or data, for example, address data, individualised contents or the like.

In the enveloping system 1, the document sets 4 are first collated by suitably merging the single documents 6 which, in their totality, form the document set 4. The document sets 4 prepared in this way are then conveyed to an insert station 10, in which they are each inserted into the associated envelope 2 so that the mail item is formed. The mail item is then discharged—as indicated by the arrow 12—and conveyed to mailing or to further processing, for example, sealing, further printing or the like.

Upstream of the insert station 10, on the material stream side, there are arranged on the one hand a first feed device 14 for supplying the envelopes 2 and on the other hand a second feed device 16 for supplying the document sets 4. A number of further feeders 18, of which only one is shown in the embodiment, can be arranged upstream of the feed device 16, by means of which further feeders the single documents 6 are first supplied and combined with one another at a combining point—as indicated by the arrow 20—to form the relevant document set 4.

The document sets 4 are supplied in succession in an order or sequence to the insert station 10 by means of the second feed unit 16 and thereby form a document material stream indicated by the arrow 22. Similarly, the envelopes 2 are in turn supplied in succession to the insert station 10 by means of the first feed unit 14 to form a sequence or order so as to form the envelope material stream indicated by the arrow 24.

The finished mail item discharged from the enveloping system 1 is to be personalised as indicated above, that is to say directed to a particular person or group of people. This means in particular that optionally all the components forming the mail item in question, that is to say on the one hand the relevant envelope 2 and on the other hand the relevant document set 4, which can in turn consist of a plurality of single documents 6, have to be associated with the same person or group of people so that the mail item is personalised correctly. In order to make this possible, the envelopes 2 are each suitably provided with an envelope identification code, for example in the form of an individualised imprint such as a barcode or the like, which permits clear identification of the person or group of people to whom the envelope 2 is to be mailed. Similarly, the document set 4, or the single documents 6 which are collated to form the document set 4, is provided with a document identification code, which permits clear association with the person or group of people in question. The identification codes both for the envelope 2 and for the document set 4 can be allocated, for example, in the form of an increasing or decreasing consecutive numbering, it being possible, by comparing the allocated identification number with further data stored in a central data bank, for example, address data or the like, to carry out the desired personalisation during the final processing, for example by printing the title or the address data.

The enveloping system 1 is specifically designed to ensure, even during production of the mail item in question, that the single documents 6 or document sets 4, on the one hand, are associated correctly and reliably with the relevant envelope 2, on the other hand, for the purposes of particularly high production quality. It is thereby to be avoided in particular that, as a result of irregularities, production downtimes or the like in one of the material streams, document sets 4 are incorrectly associated with envelopes 2 and individualised, personal single documents 6 are erroneously mailed to the wrong addressee by mistake.

In order to ensure this with particularly simple means, the first feed device 14 is associated with a first detection unit 30 and the second feed device 16 is associated with a second detection unit 32, which detection units read the identification codes of the envelopes 2, on the one hand, and of the single documents 6 or document sets 4, on the other hand, at a reading point upstream of the infeed into the insert station 10, seen from the material stream side. The identification codes that are thereby read, for example the consecutive numbering of the envelopes 2 and/or of the document sets 4, are then delivered as a log to a common control system 34, which is shown only schematically in the figure, where they are stored for further analysis. The identification codes for the document material stream, on the one hand, and the envelope material stream, on the other hand, are stored separately and with the addition of the position within the sequence of the relevant material stream determined for the article in question.

Using this data, a check is made at a check position 36 of whether, for the current position or sequence in the relevant material stream, the identification codes for the document set 4, on the one hand, and the envelope 2, on the other hand, match so that the document set 4 is correctly associated with the envelope 2. In a particularly preferred, comparatively simple, embodiment, this can be achieved by comparing the detected serial number of the document set 4 with the serial number of the envelope 2. If such a correct match is determined, the document set 4 in question and the relevant envelope 2 are supplied as a pair to the insert station 10 so that the document set 4 can be inserted into the envelope.

If, on the other hand, an incorrect pairing ("mismatch") of the document set 4 and the envelope 2 is determined at the check position 36, countermeasures are initiated in the enveloping system 1. To this end, it is provided that, when such an incorrect association is determined, further feeding of the envelopes 2 and/or document sets 4 into the insert station 10 is first stopped. For correcting the error, discharge stations 40, 42 are associated with the feed units 14, 16 at a position downstream of the check position 36 on the material stream side.

For automatic error correction when the envelopes 2 are not correctly associated with the document sets 4, that is to say in particular if a difference in the consecutive numbers of the envelopes 2, on the one hand, and the document sets 4, on the other hand, is determined at the check point 36, it is provided that the incorrect components, for example in the form of single items, are selectively removed from the respective material streams at the discharge points 40/42 until the envelopes 2 and the document sets 4 are again correctly associated in pairs. Only when that is the case is the further supply of pairs of envelopes 2 and document sets 4 to the insert station 10 authorised again.

In order to make this possible, the first feed device 14 and the second feed device 16 can be driven separately and independently of one another. The enveloping system 1 is designed according to the principle that the "leading" material stream, as regards correct synchronisation of the material streams with one another, is stopped until the other "lagging" material stream—optionally with the discharge of intermediate incorrect products—is synchronised again and has been advanced again as regards the identification codes or numbers so that correct transfer in pairs to the insert station 10 is possible.

For this purpose, a comparison is carried out in the control system 34 at the check position 36 using the identification codes, stored as a log, of the envelopes 2, on the one hand, and of the document sets 4, on the other hand, which have passed through, in order to synchronise the material streams. If correct synchronisation of the envelope 2 and the document set 4 is thereby determined, further transport to the insert station 10 is authorised. If, on the other hand, a difference is determined, correction measures are initiated by purposively individually controlling the feed devices 14, 16 and/or the discharge stations 40, 42 according to the following model: (this is explained with reference to a system for the identification codes having serial numbers in ascending order; other codes are naturally conceivable).

If, for example, in the sequential production of the envelopes 2, a correct production sequence was present up to serial number 100 but a production fault occurred at serial number 101, and therefore number 101 is not present, it is determined at the check position 36 that, after arrival of the envelope 2 having the serial number 100, the envelope 2 having the serial number 102 arrives. At the same time, it is determined at the check position 36 that, at the corresponding position in the sequence of the document set material stream—assuming correct continuous production has taken place—the document set 4 having the serial number 101 has arrived. It is thus concluded that there is an incorrect association of the envelope 2 and the document set 4 at this position in the sequences of the material streams.

In response thereto, it is determined, on the basis of the log of the serial numbers for the document sets 4, whether the serial number 101 is followed correctly in the document material stream by the document set 4 having the serial number 102. If this can be confirmed by comparison with the log, the envelope material stream is temporarily stopped by suitably controlling the drive of the first feed device 14. In the meantime, the document material stream is conveyed further by one unit by suitably controlling the drive of the second feed unit 16 so that the envelope 2 having the serial number 102 and also the document set 4 having the serial number 102 are then present at the check position 36. The document set 4 having the serial number 101, which is now situated at the discharge station 42, is discharged from the continuous material stream of document sets 4 at the discharge station 42. Correct synchronisation of the envelope material stream and the document material stream (namely for both with serial number 102) is thus achieved. Envelopes and document sets can then be conveyed further in pairs, and the envelope 2 and the document set 4, both having the serial number 102, are supplied as a pair to the insert station 10, where they are combined to form the packaged item.

If, on the other hand, a production fault also occurred in the document material stream, the following scenario could arise:

It is determined at the check position 36 that the envelope 2 having the serial number 102, on the one hand, and the document set having the serial number 101, on the other hand, are present. If it is then determined, using the corresponding log in the control unit 34, that—for example due to the production fault—the document set 4 having the serial number 102 is not present and its arrival can also no longer be expected, it is thus not possible to correctly prepare correctly the synchronised packaged item having the serial number 102. In this case, the log is then used to determine the next possible serial number—in the mentioned example, for example, serial number 103—for which both components of the packaged item are present again. Both feed units 14, 16 are then controlled such that the relevant conveyed item (that is to say the envelope 2, on the one hand, and the document set 4, on the other hand) having the serial number 103 is present at the check position 36. Upstream envelopes 2 or document sets 4 that have not been suitably synchronised, that is to say in the case of this example the envelope having the serial number 102, are discharged at the discharge stations 40, 42. Only when correctly synchronised components, that is to say both the envelope 2 having the serial number 103 and the document set 4 having the serial number 103, are at the check position 36 are they both conveyed further as a pair and supplied to the insert station 10.

The corresponding actions, that is to say in particular the purposive control of the feed units 14, 16 for further conveying the individual material streams separately and independently, as required, and the discharge of individual envelopes 2 or document sets 4 without corresponding counterparts at the discharge units 40, 42, are initiated and controlled by the control system 34. Since the individual identification codes of the respective products are already stored in the control system as a processing log and/or tracking system, preferably together with current status information regarding the processing status, and are regularly updated, this can also be used in a particularly preferred embodiment to initiate suitable corrections in response to discharge measures which have been carried out. For example, it was determined in the mentioned scenario that, because of a production fault or for other reasons, the packaged item, consisting of the envelope 2 and the document set 4, having the serial number 102 could not be produced. The corresponding diagnostic information, which was also the trigger for the discharge of the envelope 2 (without a partner) having the serial number 102, can also be used as the trigger for the repeat production of the entire non-standard packaged item having the serial number 102.

Figure 2:
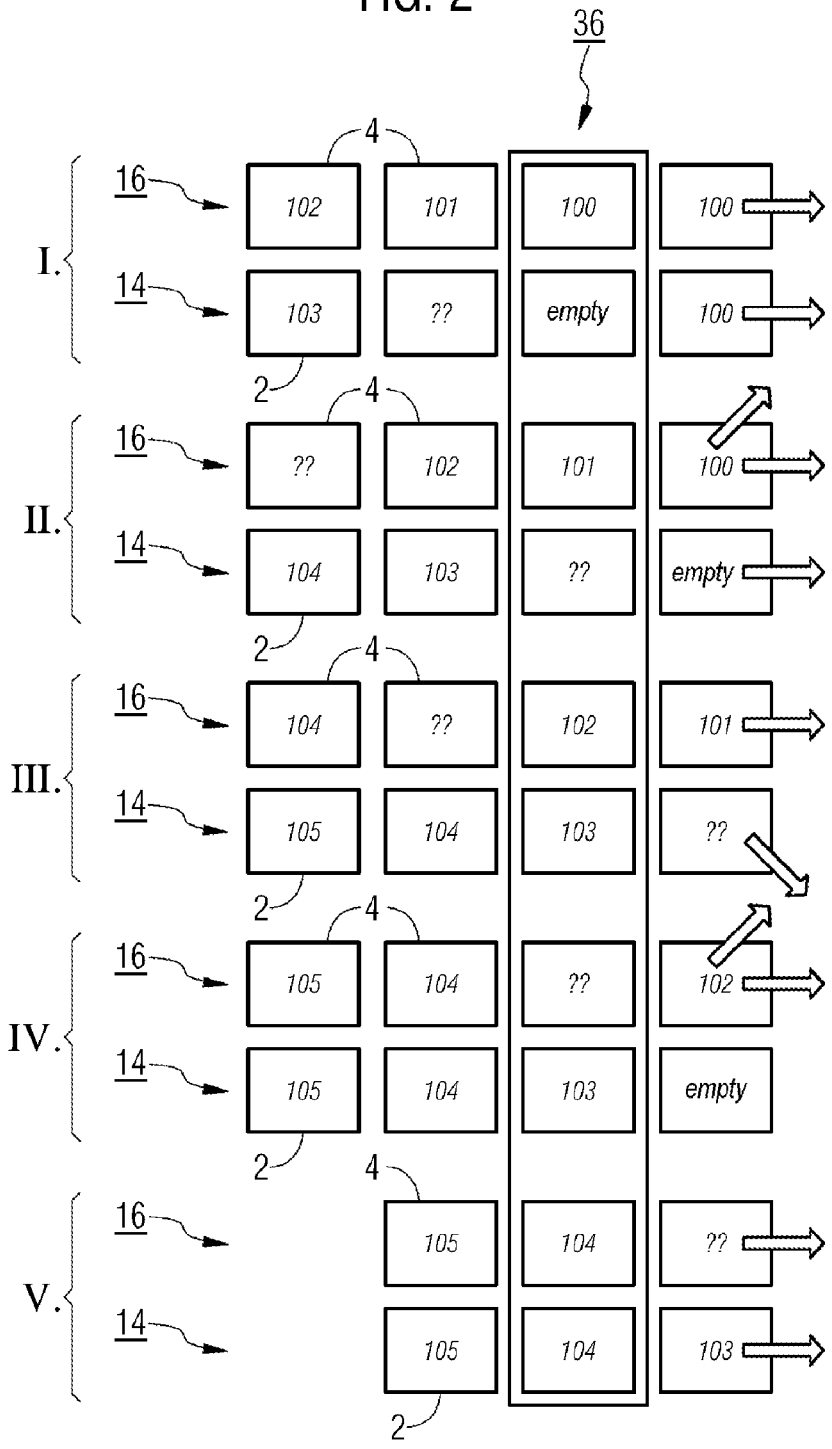
FIG. 2 is a schematic view of a number of sequence scenarios.

By detecting the identification codes in the detection units 30, 32 at a location which is significantly upstream, seen from the material stream side, of the check position 36 at which "matching", that is to say verification of the correct association of the components with one another, takes place, and subsequently detecting and providing the results as a log, it is possible to initiate corresponding correction measures in the event of faults while also taking into consideration the envelopes 2 or document sets 4 which are already in the material stream and will later still arrive at the check position 36. This allows the enveloping system 1 to react comparatively flexibly to production faults that occur, as will be explained in the following with reference to the scenarios shown by way of example in FIG. 2. In FIG. 2, the scenarios are shown by means of possible sequences (shown by consecutive numbers as identification codes) for the envelope material stream on the feed unit 14, on the one hand, and the document material stream on the feed unit 16, on the other hand.

Scenario I shows the case where one of the document sets 4 (in the present case serial number 100) has inadvertently been produced twice. At the matching or check position 36, it is thus detected that the document set 4 having the serial number 100 is present but, for example, the envelope 2 is not ("empty"). Using the dataset stored in the control system as a log, it can be determined that the packaged item having the serial number 100, consisting of the envelope 2 having the serial number 100 and the document set having the serial number 100, has already passed through the check position 36 in the correct association and is on the way to the insert station 10 (shown to the right of the check position 36 in FIG. 2). It can accordingly be concluded in the control system 34 that, in this case, the document set 4 was produced twice, and the re-produced document set 4 having the serial number 100 which is currently at the check position 36 is discharged in the following discharge station 42. Since there was no envelope 2 at the check position 36 at the same time (indication "empty"), the two feed units 14, 16 are in this situation controlled to transport the relevant material stream further.

In scenario II, the presence of the document set 4 having the serial number 101 is detected at the check position 36. An envelope with an illegible marking (??) is correspondingly present so that the correct association cannot be verified. Furthermore, it is determined on the basis of the stored data that the envelope 2 immediately before the check position 36 bears the serial number 103 and the document set 4 immediately before the check position 36 bears the serial number 102. On the basis of the ascending numbering, it is concluded therefrom that it is no longer possible to produce the packaged items having the serial numbers 101 and 102; the next possible correct association is for serial number 103. Consequently, in both material lines, the products having smaller serial numbers are discharged at the discharge stations 40, 42, and the feed units 14, 16 are controlled such that both the envelope 2 having the serial number 103 and the document set 4 having the serial number 103 are at the check position 36. As soon as this is verified, they are together conveyed further to the insert station 10. It is further detected that it was not possible to produce the packaged items having the serial numbers 101 and 102, and a request for later production of those packaged items is generated in the control system 34.

In scenario III it is determined that the envelope 2 having the serial number 103 and the document set 4 having the serial number 102 are present at the check position 36. The envelope 2 having the serial number 102 is not situated in the material stream before the check position 36. The feed unit 16 with the document material stream is therefore selectively controlled alone, while the feed unit 14 having the envelope material stream is temporarily stopped. The document set having the serial number 102 is then discharged at the discharge station 42 and the correct association of the mail item having the serial number 103 is verified. The envelope 2 having the serial number 103 and the document set 4 having the serial number 103 are then together passed to the insert station 10. Re-production of the mail item having the serial number 102 may be requested.

Scenario IV shows a special situation in which, at the same time as the envelope 2 having the serial number 103, the presence of a document set 4 at the check position 36 is detected, but the identification code thereof cannot be determined (for example is illegible) (??). A direct verification of the correct association is thus not possible. On the other hand, however, it is determined that both the envelope having the serial number 104 and the document set having the serial number 104 are present immediately before the check position 36. It can therefore be assumed that the document set 4 at the check position 36 is the document set having the "correct" serial number 103. In this case, both material streams are conveyed further, but the "dubious and unverified" packaged item having the serial number 103 is subjected to a special check, and optionally to a manual check, upstream or downstream of the insert station 10, and for that purpose is suitably discharged from the actual material stream.

Scenario V again shows the desired normal case, in which both material streams are synchronised with one another in the desired manner and are accordingly transported further together and in parallel.

The invention claimed is:

1. Method for supplying document sets (4) and inserting document sets into associated envelopes (2), in which the document sets (4) are supplied to an insert station (10) in a document material stream formed by a sequence of document sets (4) and the envelopes (2) are supplied to the insert station in an envelope material stream formed by a sequence of envelopes (2), wherein in the insert station (10), the document set (4) supplied in each case is inserted into the relevant envelope (2) supplied at the same time, for each document set (4) guided in the document material stream, the position thereof in the document sequence and a document identification code associated therewith are detected, and for each envelope (2) guided in the envelope material stream, the position thereof in the envelope sequence and an envelope identification code associated therewith are detected, a document set (4) and an envelope (2) are supplied to the insert station (4) only as a pair and the supply thereof is authorised only when it is confirmed on the basis of the relevant document identification code and the relevant envelope identification code that the envelope (2) pending supply is individually associated with the document set (4) pending supply, and the identification codes of the envelopes (2) and document sets (4) guided in the material streams are stored in a control unit (34), wherein when the envelope pending supply is not individually associated with the document set pending supply, it is determined on the basis of the stored identification codes whether the document set that is individually associated with the envelope pending supply or the envelope that is individually associated with the document set pending supply is already in the corresponding material stream, and, if so, one of the envelope material stream and the document material stream is stopped until the envelope and the document set that are individually associated with one another are synchronized.

2. Method according to claim 1, in which envelopes (2) and/or document sets (4) for which no associated document set (4) or envelope (2) can be detected are discharged from the relevant material stream before supply to the insert station (10).

3. Enveloping system (1) having an insert station (10) upstream of which, on a material stream side, there are arranged a first feed device (14) for supplying envelopes (2) and a second feed device (16) for supplying document sets (4), wherein the feed devices (14, 16) can be driven separately and independently of one another, wherein the feed devices (14, 16) each have a detection unit (30, 32) for reading respective identification codes affixed to envelopes (2) or document sets (4), wherein the detection units (30, 32) are each connected on a data output side to a central control unit (34), and wherein the central control unit (34) authorises the supply of a document set (4) and an envelope (2) to the insert station (10) only as a pair and only when it is confirmed on the basis of the relevant document identification code and the relevant envelope identification code that the envelope (2) pending supply is individually associated with the document set (4) pending supply, and in the case where the envelope (2) pending supply is not individually associated with the document set (4) pending supply, the control unit determines on the basis of the stored identification codes whether the document set (4) that is individually associated with the envelope (2) pending supply or the envelope (2) that is individually associated with the document set (4) pending supply is already in the corresponding material stream, and, if so, one of the envelope material stream and the document material stream is stopped until the envelope (2) and the document set (4) that are individually associated with one another are synchronized.

4. Enveloping system (1) according to claim 3, the control unit (34) of which is designed to control the driving of the feed devices (14, 16) depending on the identification codes determined in the detection units (30, 32).

* * * * *